US010244849B2

(12) United States Patent
Marino

(10) Patent No.: US 10,244,849 B2
(45) Date of Patent: Apr. 2, 2019

(54) BOTTLE HOLDING SYSTEM FOR BACKPACKS

(71) Applicant: Martin Donald Marino, Richboro, PA (US)

(72) Inventor: Martin Donald Marino, Richboro, PA (US)

( * ) Notice: Subject to any disclaimer, the term of this patent is extended or adjusted under 35 U.S.C. 154(b) by 0 days.

(21) Appl. No.: 14/545,232

(22) Filed: Apr. 10, 2015

(65) Prior Publication Data

US 2015/0289630 A1 Oct. 15, 2015

Related U.S. Application Data

(60) Provisional application No. 61/978,226, filed on Apr. 11, 2014.

(51) Int. Cl.

| | |
|---|---|
| ***A45F 3/04*** | (2006.01) |
| ***A45F 3/16*** | (2006.01) |
| *A45C 13/40* | (2006.01) |
| *A45F 3/00* | (2006.01) |

(52) U.S. Cl.

CPC ..... *A45F 3/04* (2013.01); *A45F 3/16* (2013.01); *A45C 13/40* (2013.01); *A45F 2003/001* (2013.01); *A45F 2003/166* (2013.01); *A45F 2200/0583* (2013.01)

(58) Field of Classification Search

CPC ..... A45F 2003/166; A45F 2003/001; A45F 2200/0583

USPC ..... 600/491, 498

See application file for complete search history.

(56) References Cited

U.S. PATENT DOCUMENTS

| | | | | |
|---|---|---|---|---|
| 2,006,878 A * | 7/1935 | Bandoly | A61B 5/0235 | 137/614.11 |
| 3,254,671 A * | 6/1966 | Berliner | A61B 5/0235 | 137/565.12 |
| 4,848,625 A * | 7/1989 | Lucia | B62J 11/00 | 224/148.4 |
| 6,138,882 A * | 10/2000 | Buettner | A45C 13/00 | 190/102 |
| 6,302,364 B1 * | 10/2001 | Chiueh | B60N 3/10 | 206/545 |
| 6,382,490 B1 * | 5/2002 | Divincenzo | A01K 97/06 | 206/315.11 |
| 6,467,665 B1 * | 10/2002 | Jenkins | A45F 3/04 | 224/628 |

(Continued)

*Primary Examiner* — Scott T McNurlen

(74) *Attorney, Agent, or Firm* — Armand M. Vozzo, Jr.

(57) ABSTRACT

A bottle holding system for installed use upon a backpack comprises an inflatable cuff substantially cylindrical in configuration and adapted for positioned attachment to the outer side of the backpack, the cuff formed having a sealed chamber therein to support its inflation and sized to hold a bottle of drinking fluid when inflated. Tubing connected at one end to the cuff chamber is routed along the interior of the backpack, extending outwardly from the backpack near the shoulder straps to connect with a flexible bulb member mounted on one of the shoulder straps with an air release valve connected in-line there between. In operation, the user inflates the cuff through the air release valve, squeezing the bulb to retain the bottle in the inflated cuff, and when drinking fluid is needed, actuates the valve to vent air from the cuff so that the bottle is easily retrieved by the user.

13 Claims, 2 Drawing Sheets

(56) References Cited

U.S. PATENT DOCUMENTS

| | | | | |
|---|---|---|---|---|
| 6,637,617 | B2 * | 10/2003 | Eisenbraun | B60N 3/103 220/720 |
| 2004/0031895 | A1 * | 2/2004 | Langhoff | B60N 3/105 248/311.2 |
| 2007/0218096 | A1 * | 9/2007 | Wooley | A61H 9/0078 424/411 |
| 2009/0179046 | A1 * | 7/2009 | Reichert | A45F 3/20 222/95 |
| 2009/0302082 | A1 * | 12/2009 | Freeny | A45F 3/00 224/661 |
| 2013/0082077 | A1 * | 4/2013 | Millman | A45F 4/02 224/153 |

* cited by examiner

BOTTLE HOLDING SYSTEM FOR BACKPACKS

CROSS-REFERENCE TO RELATED APPLICATION

This application is a continuation-in-part of provisional patent application Ser. No. 61/978,226 filed Apr. 11, 2014 for the Squiz Greep.

BACKGROUND OF THE INVENTION

The present invention relates to backpacks worn by users engaged in outdoor recreational activities, such as hiking, camping, and wilderness traveling, and more particularly, to an improved bottle holding system installed upon a backpack unit to carry a bottle of water or other liquid in a retained but readily available position with the further capability of being user-actuated to release the bottle from the retained position when needed and replaced into the retained position thereafter.

Backpacks are widely used by hikers and other pedestrian travelers involved in outdoor recreational activities that may extend for long periods of time, most commonly in wilderness hiking and camping, with the backpacks serving as a most convenient means for carrying the gear and supplies needed by the traveler during the extended time of a journey. Hiking backpacks, as they are often called, are generally made having a closable bag-like rear casing of a certain volume that is constructed of strong fabric and formed in a compartmentalized fashion to allow storage of a variety of separate items considered important to the hiker. The rear casing of the backpack is typically supported upon a rigid frame and further coupled to a forward harnessing arrangement of adjustable belts and straps that include a pair of shoulder straps, one or more waist belts and sometimes other intermediate torso straps that together allow the backpack to be worn securely and in a stabilized manner upon the back of the hiker whether full or partially-loaded with gear, supplies and other important items.

One of the most important items to the hiking traveler and certainly an essential one for carrying on a backpack is a supply of drinking water or other liquid for hydration. To supply this vital element of drinking water, some backpacks are found equipped with a personal hydration system that generally includes a water reservoir or fluid bladder incorporated into the rear casing of the backpack and a hose that leads from the reservoir or bladder to a mouthpiece that is used by the hiker to obtain a drink of the water of other fluid. Prior art examples of these personal hydration systems fitted and equipped upon backpacks are shown and described in U.S. Pat. No. 5,975,387 to Gleason et al. and U.S. Pat. No. 7,044,343 to Anue. While these personal hydration systems incorporated into backpack units have been generally satisfactory in supplying drinking water to the user when desired, their working operation requires regular cleaning and maintenance of the system and together with the added initial cost of the backpack equipped with such personal hydration systems, limits their desirability and practicality to a substantial group of backpack users who require a more convenient and less complicated system for providing drinking water when needed.

Since convenience is an important factor when traveling with a backpack, most backpack users rely on getting their hydration directly from a bottle container of water or other liquid carried in a separate compartment on the backpack. Unfortunately, many of those backpack compartments adapted to carry a water bottle or other fluid container are difficult to reach and retrieve, especially while in transit and without stopping to remove the backpack. Since it is vital for a hiker to remain hydrated and always have ready access to fluids, particularly after extended periods exposed to the sun, there is a need for an improvement that can be incorporated into the standard construction of a hiking backpack that will provide easy and convenient access to a bottled supply of drinking fluid carried on the backpack without stopping to remove the backpack.

SUMMARY OF THE INVENTION

Accordingly, it is a general purpose and object of the present invention to provide an improved system capable of integral installation upon standard hiking backpacks to provide the backpack user with a ready and convenient access to a bottled supply of drinking water or other hydrating fluid carried on the backpack.

A more particular object of the present invention is to provide an improved means incorporated within the standard construction of a hiking backpack and affixed thereto for selectively delivering a bottle supply of water or other hydrating fluid from a stored position on the backpack to the user whenever desired.

Another object of the present invention is to provide an improved backpack system for keeping a ready supply of hydrating fluid for convenient access to the backpack user when needed.

Still another object of the present invention is to provide an improved backpack system for providing the user with a ready supply of bottled water that is reliable and easy to use and maintain.

Further objects of the present invention are to provide an improved bottle holding system for backpacks that is inexpensive to assemble and relatively easy to install or retrofit upon existing backpack units.

Briefly, these and other objects of the present invention are accomplished by a bottle holding system intended for installed use upon a hiking backpack of the type having adjustable shoulder straps forwardly situated and coupled to a rear casing wherein gear and supplies are contained. The bottle holding system comprises an inflatable cuff member substantially cylindrical in configuration and adapted for positioned attachment to the outer side of the rear casing, the cuff formed having a sealed chamber therein to support its inflation and sized to hold a typically shaped bottle of water or other drinking fluid when inflated. A length of tubing is connected at one end to the cuff chamber and routed upward from the positioned attachment of the cuff along the interior of the rear casing, further extending outwardly from the rear casing in proximity to the shoulder straps. A flexible bulb member mounted on a selected one of the shoulder straps is adapted to receive the other end of the tubing with an air release valve connected in-line there between. With the air release valve normally set to allow air from the bulb to flow through to the tubing, the user may inflate the cuff by squeezing the bulb and thereby retain the bottle in the inflated cuff until drinking fluid is desired. When drinking fluid is needed, the user will actuate the valve to vent air pressure therefrom, deflating the cuff so that the bottle is disengaged and easily retrieved by the user.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DESCRIPTION OF THE INVENTION

Figure 1:
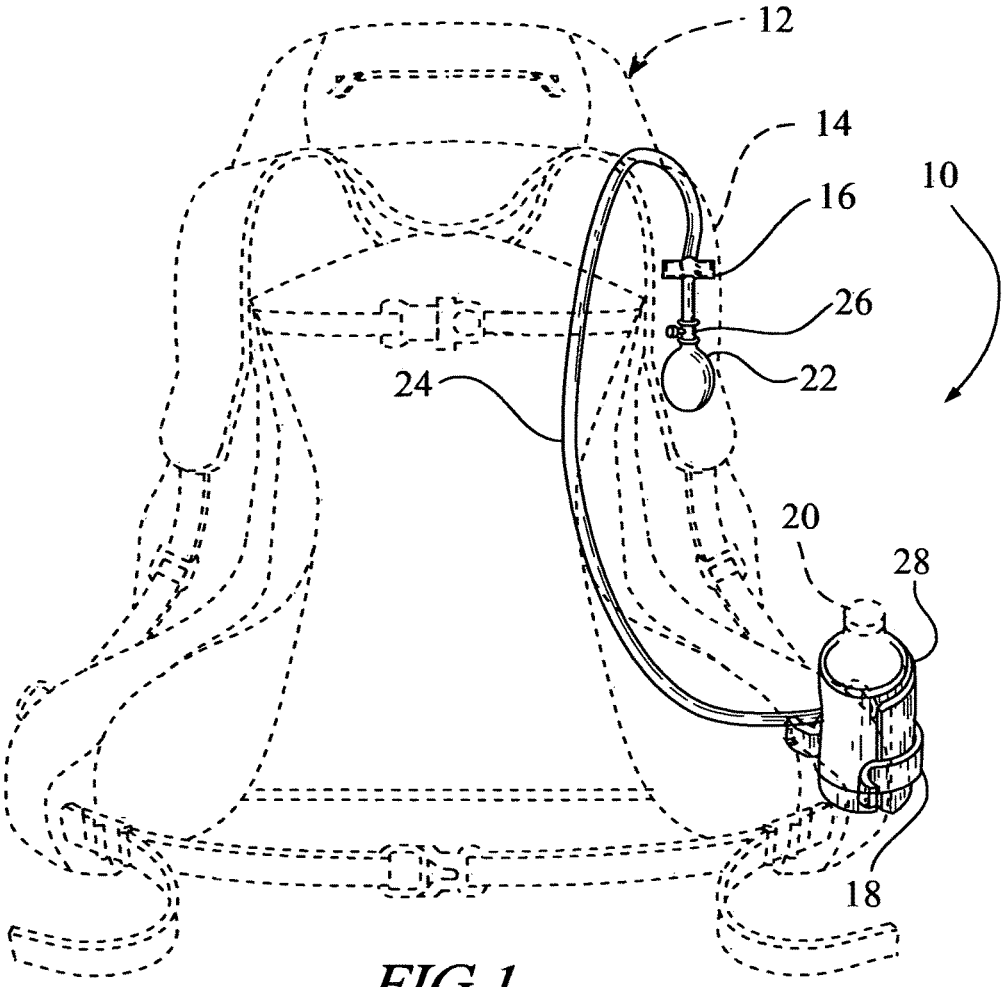
FIG. 1 is a front elevation view of the bottle holding system assembled and installed upon a standard hiking backpack (shown entirely in phantom outline) in accordance with the present invention.

The following serves to describe a preferred embodiment of the present invention and the best presently contemplated mode of its production and practice. This description is further made for the purpose of illustrating the general principles of the invention but should not be taken in a limiting sense, the scope of the invention being best determined by reference to the appended claims.

Referring to the drawings, the following is a list of structural components of the present magazine device, generally designated 10, and those associated structural elements shown employed in connection with the present invention:

10 bottle holding system;
12 backpack;
14 shoulder strap;
15 rear casing;
16 fabric strip;
18 fabric band;
20 bottle;
22 flexible bulb member;
24 tubing;
26 air release valve; and
28 inflatable cuff member.

Referring now to FIG. 1, the present bottle holding system, generally designated 10, is shown assembled and installed upon a typical hiking backpack 12 that is generally made of woven fabric material and constructed having a pair of adjustable shoulder straps 14 forwardly situated and extending from the top to the bottom on either side of the backpack in support of a rear casing 15 positioned on the user's back, the rear casing having one or more compartments wherein gear and supplies may be stored and carried. In accordance with the present invention, the bottle holding system 10 comprises a flexible bulb member 22, a length of flexible tubing 24 coupled to the bulb member at one end of the tubing through an air release valve 26, and an inflatable cuff member 28 operatively connected at the other end of the tubing, the cuff member being adapted in its structure and form to releasably engage a standard sized drinking bottle 20 (shown in dotted outline) or other drinking fluid container of commercial availability at a fixed position alongside of the backpack 12 within reach of a user thereof.

Figure 2:
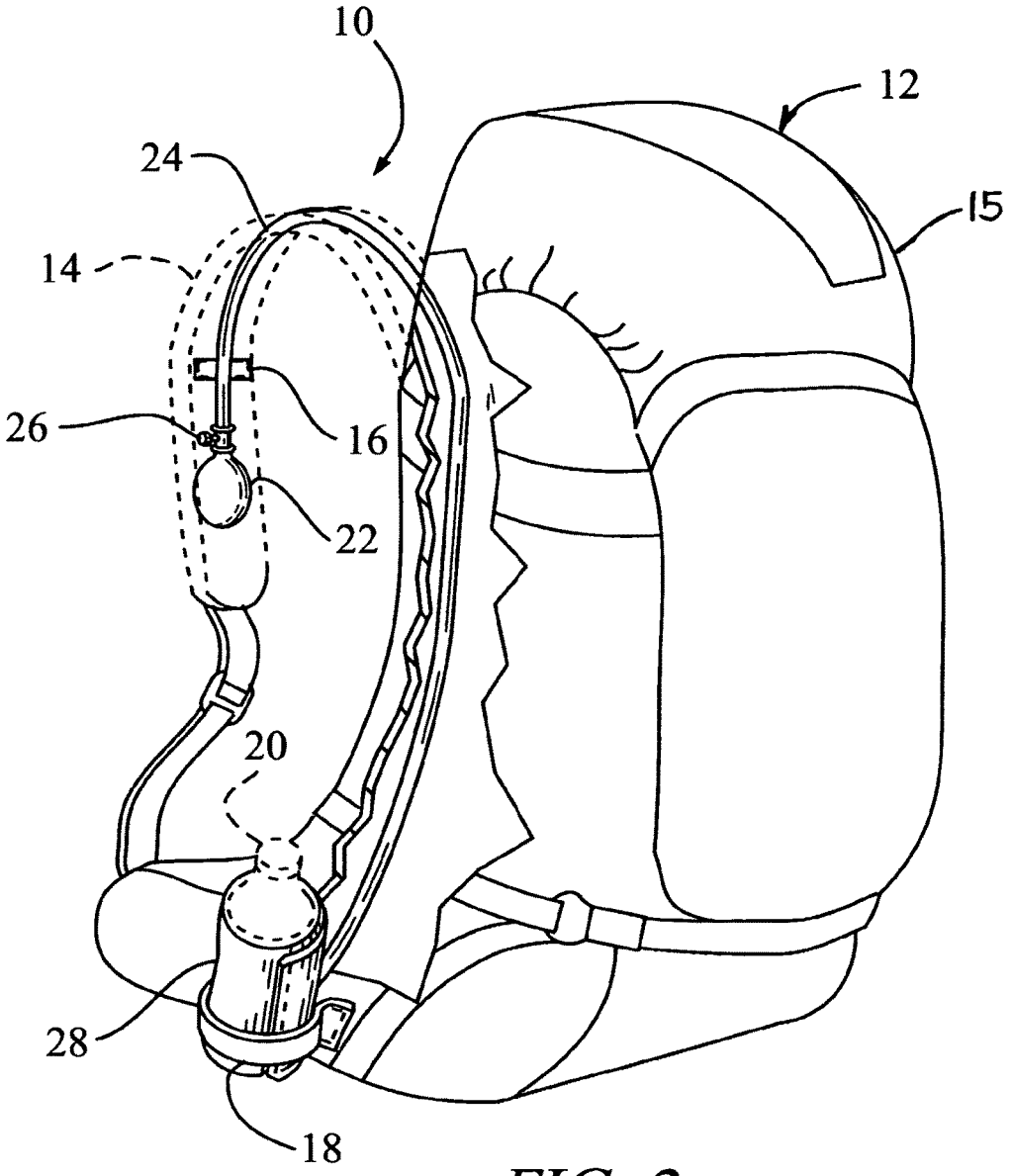
FIG. 2 is a perspective side view of the installed bottle holding system of FIG. 1 shown in connection with the hiking backpack depicted partially in phantom outline and with a portion of its near side cut away.

In its assembled state, the bottle holding system 10 is preferably installed having the bulb member 22, air release valve 26 and forward most portion of the flexible tubing 24, together in their connected combination, secured to one of the front shoulder straps 14 using a fabric strip 16 or one of leather sewn or otherwise attached over the tubing along the forward facing surface of the shoulder strap to hold these connected components in place. From its forward connection with the bulb member 22 and associated air pressure release valve 24, the length of flexible tubing 24 is preferably routed into and through the backpack 12, entering near the top of the associated shoulder strap 14. Extending through an interior section of the rear casing 15, the length of tubing 24 exits on the side of the backpack 12 where connection is made with the cuff member 28 positioned in mounted attachment to the exterior of the rear casing. A fabric band 18 or one of leather material looped about the cuff member 28 is sewn or otherwise attached to the rear casing 15 to secure the mounted attachment of the cuff member, as best seen in FIG. 2. It should be noted and understood that the separate mounted positions of the assembled components of the present bottle holding system 10 may be established on alternate sides of the backpack 12, with the inflation bulb member 22 and its associated release valve 26 mounted to the shoulder strap 14 on the same side that the cuff member 28 is mounted to the rear casing 15, as is shown in the present drawings, or on opposite sides thereof. As a further alternative within the scope of the present invention, the length of tubing 24 extending between the respective mounted positions of the bulb member 22 and air release valve 26 on the shoulder strap 14 and the cuff member 26 on the rear casing 15 may be routed along the outside of the backpack 12 rather than through the inside thereof, as depicted and described above in the preferred embodiment of the present bottle holding system 10.

Referring now to FIG. 2 in conjunction with FIG. 1, the inflatable cuff member 28 is made to be substantially cylindrical in its configuration, the cuff member being constructed of a strong and durable plain-woven fabric material, such as canvas, having a sealed chamber lined within the exterior surfaces of the cuff member that is fitted to receive and engage the tubing 24 at one end thereof. The cuff member 28 is preferably formed as a single cylindrically-shaped body that is sized to fit loosely about the drinking bottle 20 when in its deflated condition, and adapted to expand when inflated, particularly in an inward direction, to close about the drinking bottle and grip it securely. The cuff member 28 may alternatively be constructed in a planar form that can be wrapped together and joined at opposite ends to form the substantially cylindrical configuration that is preferred. As a further alternate form for construction of the inflatable cuff member 28, a surface layer may be provided at the bottom of the cylindrical configuration of the body for increased support and confinement of the drinking bottle 20, particularly while the cuff member is in a deflated condition. Such a bottom end surface added to the cuff member 28, however, will limit the user's retrieval of the drinking bottle 20 to a lifted removal from the top of the deflated cuff member.

Extending from connected engagement with the cuff member 28 and its associated sealed interior chamber, the length of tubing 24 is routed upward from the positioned attachment of the cuff member and preferably along the interior of the rear casing 15. Exiting from the rear casing 15 near the top of the backpack 12 in proximity to the upper end of the shoulder strap 14, the opposite end of the length of tubing 24 is routed along the shoulder strap and made to engage in a sealed in-line coupling with the air release valve 26 and bulb member 22 that are together assembled and mounted in place on the shoulder strap. The bulb member 22 is a conventional air cell unit made of flexible rubber in the form of a spheroid having an opening at one end and typically a one-way inlet valve at an opposite end that admits air into the bulb so that the air is forced out of the open end of the bulb when compressed. The air release valve 26 is a conventional pressure relief device of the type most commonly used in combination with a conventional air cell unit like bulb member 22 to control the air flow and inflation of blood pressure measuring instruments. The air release valve 26 is generally formed having an internal axial bore that extends therethrough and is adapted at its ends to engage in a sealed coupling between the open end of the bulb member 22 and the open end of tubing 24, and a further transverse bore wherein a control valve stem is internally situated and movably disposed by screw rotation or by push-button actuation to cause a pressure release from the valve that can gradually or instantly vent the system and deflate the cuff member 28. A suitable type of air release valve 26 to combine with bulb member 26 for use in the present bottle holding system 10 is that push control valve shown and described in U.S. Pat. No. 3,254,671, the specification of which is hereby incorporated by reference. With the air release valve 26 normally set to allow air from the bulb member 26 to flow through to the tubing, the user may inflate the cuff member 28 by squeezing the bulb and thereby retain the bottle in the inflated cuff member until drinking fluid is desired. When drinking fluid is needed, the user will actuate the valve 26 to release air pressure therefrom, deflating the cuff so that the bottle is disengaged and easily retrieved by the user.

Assembled and installed as described above and further shown in the drawing figures, the present bottle holding system 10 initially functions and serves to hold and retain the drinking bottle 20 firmly within the cylindrical walls of the inflated cuff member 28 positioned in an easily reachable area along the side of the backpack 12. For this functional state, the backpack user squeezes the bulb member 22 enough times to inflate the cuff member 28 with sufficient air pressure to securely grip the bottle 20. At any time during transit when drinking fluid is needed, the backpack user, while reaching with one hand to the positioned attachment of the inflated cuff member 28, actuates the air release valve 26 with the other hand to vent the air from the tubing 24 thereby deflating the cuff member and releasing the bottle 20 to the user's hand. Once the user has finished drinking from the bottle 20, the same bottle or another may be reinserted into the cuff member 28 and secured in place again by re-inflating the cuff member about the bottle by squeezing the bulb member 22.

Therefore, it is apparent that the described invention provides an improved system capable of being incorporated upon standard hiking backpacks to provide the backpack user with a ready and convenient access to a bottled supply of drinking water or other hydrating fluid carried on the backpack. More particularly, the disclosed invention provides an improved means able to be integrated and used in conjunction with the standard construction of a hiking backpack to selectively deliver to the user a bottle supply of water or other hydrating fluid from a retained position on the backpack whenever desired. The disclosed bottle holding system improves backpack performance and capabilities by keeping a ready supply of hydrating fluid for convenient access to the backpack user when needed, and is reliable and easy to use and maintain. In addition, disclosed bottle holding system is inexpensive to assemble and relatively easy to install or retrofit upon existing backpack units.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Furthermore, certain modifications to the described embodiment that serve to benefit its usage are within the scope of the present invention. For example, a flexible band or wrap of Velcro tape material or even a small pocket of fabric material can be attached to the shoulder strap 15 in proximity to the mounted location of the bulb member 22 and adapted to loosely retain the bulb member to the strap, provide it with some degree of protection and keep the bulb from swinging back and forth while hiking. As a further example, fabric sleeves of various lengths sized to fit the tubing 24 may be provided along the surfaces of the backpack 12, both inside and along its exterior, to guide and retain the length of tubing along its routed path. Accordingly, it is understood that this invention is not limited to the particular embodiment described, but rather is intended to cover modifications within the spirit and scope of the present invention as expressed in the appended claims.

What is claimed is:

1. A bottle holding system for use by a wearer of a hiking backpack having one or more shoulder straps forwardly situated and secured to the backpack in support of a rear casing thereon having an exterior side and an interior compartment, comprising:

an inflatable cuff member formed having a cylindrical and open-ended configuration with an open top and an open bottom in both a deflated and inflated condition, said cuff member being positioned for mounted attachment to the exterior side of the rear casing and sized to fit around a bottle of drinking fluid along the length thereof so that the bottle is retained exclusively within the cylindrical configuration of said cuff member when inflated and released therefrom through the open bottom to a hand of the wearer when deflated;

banded means for attaching said cuff member to the exterior side of the rear casing, said banded means comprising a flexible band member assembled about said cuff member and connected to the rear casing;

a length of tubing connected at one end thereof to said cuff member and routed from the positioned attachment of said cuff member along the interior compartment of the rear casing, said length of tubing further extending outwardly from the rear casing in proximity to the shoulder straps;

a bulb member flexible in form and coupled to receive the other end of said length of tubing, said bulb member being mounted on a selected one of the shoulder straps; and an air release valve connected in-line between said bulb member and the other end of said length of tubing, said air release valve having a controlled actuation to cause a pressure release from said valve and a deflation of said cuff member.

2. A bottle holding system according to claim 1, wherein said cuff member is constructed in a single continuous cylindrical form having a sealed chamber therein to support its inflation.

3. A bottle holding system according to claim 1, wherein said cuff member is constructed in a planar form wrapped together and joined at opposite ends to form the cylindrical configuration, the planar form of said cuff member further having a sealed chamber therein to support its inflation.

4. A bottle holding system according to claim 1, wherein said bulb member is made in the form of a spheroid having an opening at one end thereof to provide air flow therefrom upon compression of said bulb member.

5. A bottle holding system according to claim 4, wherein the controlled actuation of said air release valve is effected by a push button motion applied to said air release valve.

6. A bottle holding system according to claim 4, wherein the controlled actuation of said air release valve is effected by a rotational screw motion applied to said air release valve.

7. An improved backpack having one or more front shoulder straps and a rear casing connected thereto, wherein the improvement comprises a releasable holder for a container of drinking fluid operated by a wearer, consisting of:

an inflatable cuff cylindrical and open-ended in configuration having an open top and an open bottom and positioned for mounted attachment to the rear casing, the cuff formed having a sealed chamber therein to support its inflation and sized to wrap around the container of drinking fluid along the length thereof so that the container is supported exclusively within the cylindrical configuration of said cuff when inflated and released therefrom through the open bottom to a hand of the wearer when deflated;

means for banded attachment of said cuff to the rear casing, said means for banded attachment comprising a flexible band member assembled about said cuff and connected to the rear casing;

a length of tubing having one end thereof connected to the sealed chamber of said cuff chamber and routed upward from the positioned attachment of said cuff along the rear casing, further extending from the rear casing in proximity to the shoulder straps;

a flexible bulb member mounted on a selected one of the shoulder straps and operatively connected to receive the other end of said length of tubing; and an air release valve connected in-line between said bulb member and the other end of said length of tubing, said air release valve being capable of a controlled actuation to cause a pressure release from said valve and a deflation of said cuff member.

8. The improved backpack of claim 7, wherein said length of tubing is routed from said cuff into the backpack and within the rear casing before extending therefrom in proximity to the shoulder straps.

9. The improved backpack of claim 7, wherein said cuff is constructed in a single continuous cylindrical form.

10. The improved backpack of claim 7, wherein said cuff is constructed in a planar form wrapped together and joined at opposite ends to form the cylindrical configuration.

11. The improved backpack of claim 7, wherein said flexible bulb member is made in the form of a spheroid having an opening at one end thereof to provide air flow therefrom upon compression of said bulb member.

12. The improved backpack of claim 7, wherein the controlled actuation of said air release valve is effected by a push button motion applied to said air release valve.

13. The improved backpack of claim 7, wherein the controlled actuation of said air release valve is effected by a rotational screw motion applied to said air release valve.

* * * * *